US011072760B2

(12) United States Patent
Pasanen et al.

(10) Patent No.: US 11,072,760 B2
(45) Date of Patent: Jul. 27, 2021

(54) PURIFICATION OF BIOMASS-BASED LIPID MATERIAL

(71) Applicant: Neste Oyj, Espoo (FI)

(72) Inventors: Jukka-Pekka Pasanen, Porvoo (FI); Jarmo Halttunen, Porvoo (FI); Annika Malm, Porvoo (FI); Väinö Sippola, Porvoo (FI)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 16/958,885

(22) PCT Filed: Dec. 28, 2018

(86) PCT No.: PCT/FI2018/050984

§ 371 (c)(1),
(2) Date: Jun. 29, 2020

(87) PCT Pub. No.: WO2019/129933

PCT Pub. Date: Jul. 4, 2019

(65) Prior Publication Data

US 2020/0339911 A1 Oct. 29, 2020

(30) Foreign Application Priority Data

Dec. 29, 2017 (FI) ..... 20176184

(51) Int. Cl.
*C11B 3/12* (2006.01)
*C11B 3/00* (2006.01)
(Continued)

(52) U.S. Cl.
CPC ..... *C11B 3/12* (2013.01); *C11B 3/001* (2013.01); *C11B 3/008* (2013.01); *C11B 13/00* (2013.01); *C11B 3/10* (2013.01)

(58) Field of Classification Search
CPC . C11B 3/12; C11B 3/001; C11B 3/008; C11B 3/10; C11B 13/00
(Continued)

(56) References Cited

U.S. PATENT DOCUMENTS 2,368,669 A 2/1945 Porter et al.
3,984,447 A 10/1976 Cooper et al.
(Continued)

FOREIGN PATENT DOCUMENTS

EP 1741767 A1 1/2007
WO 2012062963 A1 5/2012
WO 2013156683 A1 10/2013

OTHER PUBLICATIONS

International Search Report issued in corresponding International Patent Application No. PCT/FI2018/050984, 4 pages, dated Mar. 5, 2019.
(Continued)

*Primary Examiner* — Deborah D Carr
(74) *Attorney, Agent, or Firm* — Buchanan Ingersoll & Rooney PC

(57) ABSTRACT

A method of purifying biomass-based lipid material, as disclosed includes providing a feed of biomass-based lipid material; optionally drying the feed; removing oxygen from the feed under reduced pressure; heat treating the feed at 180 to 300° C. under reduced pressure to solidify at least part of phosphorous and/or metal containing impurities, simultaneously distilling off at least part of free fatty acids and low molecular weight nitrogen compounds, to obtain at least a fraction containing free fatty acids and low molecular weight nitrogen compounds, and heat treated biomass-based lipid material containing degraded phosphorous and/or metal containing impurities in solid form; and removing the solid degraded phosphorous and/or metal containing impurities from the second fraction.

19 Claims, 3 Drawing Sheets

(51) Int. Cl.
*C11B 13/00* (2006.01)
*C11B 3/10* (2006.01)

(58) Field of Classification Search
USPC ..... 554/8
See application file for complete search history.

(56) References Cited

U.S. PATENT DOCUMENTS

| | | | | |
|---|---|---|---|---|
| 4,599,143 | A | 7/1986 | Stage | |
| 6,423,857 | B1 | 7/2002 | Copeland et al. | |
| 2006/0189815 | A1* | 8/2006 | Tou | C11B 3/001 549/413 |
| 2008/0103204 | A1 | 5/2008 | Weller et al. | |
| 2008/0269513 | A1* | 10/2008 | Sarangan | C11C 3/003 554/13 |
| 2009/0069610 | A1 | 3/2009 | Roberts et al. | |
| 2011/0077436 | A1 | 3/2011 | Yao et al. | |
| 2011/0105813 | A1 | 5/2011 | Roberts et al. | |
| 2012/0108861 | A1 | 5/2012 | Roberts et al. | |
| 2013/0102818 | A1 | 4/2013 | Roberts et al. | |
| 2014/0020282 | A1 | 1/2014 | Lavella et al. | |

OTHER PUBLICATIONS

Written Opinion of the International Searching Authority issued in corresponding International Patent Application No. PCT/FI2018/050984, 6 pages, dated Mar. 5, 2019.

* cited by examiner

PURIFICATION OF BIOMASS-BASED LIPID MATERIAL

FIELD OF THE INVENTION

The present invention relates to a method of purifying biomass-based lipid material, in particular biomass-based lipid material comprising phospholipids, free fatty acids (FFA) and nitrogen containing compounds.

BACKGROUND OF THE INVENTION

Biomass-based lipid material typically contains phosphorous, nitrogen and/or metal containing impurities such as phospholipids and other impurities such as free fatty acids (FFA). Before catalytic processing of the biomass-based lipid material to traffic fuels or chemicals these impurities need to be removed to prevent catalyst deactivation and/or plugging during processing. Also high concentration of toxic ammonia may be generated from the nitrogen compounds if the biomass-based lipid material is processed by hydrogenation. Furthermore, in traffic fuels nitrogen compounds cause NOx emissions. FFAs may cause corrosion in the process units.

Generally refining processes used before catalytic production of fuels or chemicals are adopted from edible oil refining and are typically divided between chemical and physical refining.

Known chemical refining methods include degumming and bleaching. In degumming removal of impurities is achieved by altering the solubility of impurities in fat using chemicals (typically acid) and by removing the formed solid material, i.e., gums. In bleaching removal of impurities is achieved using adsorption on clay.

Known physical refining methods include distillation also known as deodorization. In deodorization removal of free fatty acids and odor compounds is achieved as given amount of a stripping agent, usually steam, is passed for a given period of time through material to remove the volatile free fatty acids and odor compounds.

However, these techniques are not be fully suitable for the most difficult biomass-based lipid materials such as animal fat, damaged rapeseed oil, used cooking oil, or algae oil as impurities cannot be removed to an acceptable level.

BRIEF DESCRIPTION OF THE INVENTION

An object of the present invention is thus to provide a method so as to overcome the above problems. The objects of the invention are achieved by a method which is characterized by what is stated in the independent claims. The preferred embodiments of the invention are disclosed in the dependent claims.

The invention is based on the surprising realization that content of impurities in biomass-based lipid material may be lowered to a desirable level by a method that leads to simultaneous removal of FFA, phosphorous, nitrogen, and metal compounds as the biomass-based lipid material is heated at 180 to 300° C. under reduced pressure for a given period of time and simultaneously distilling off impurities evaporating under the induced conditions.

The method allows use of low quality biomass-based lipid material feeds as a feedstock to processes producing high quality renewable fuels and/or chemicals.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
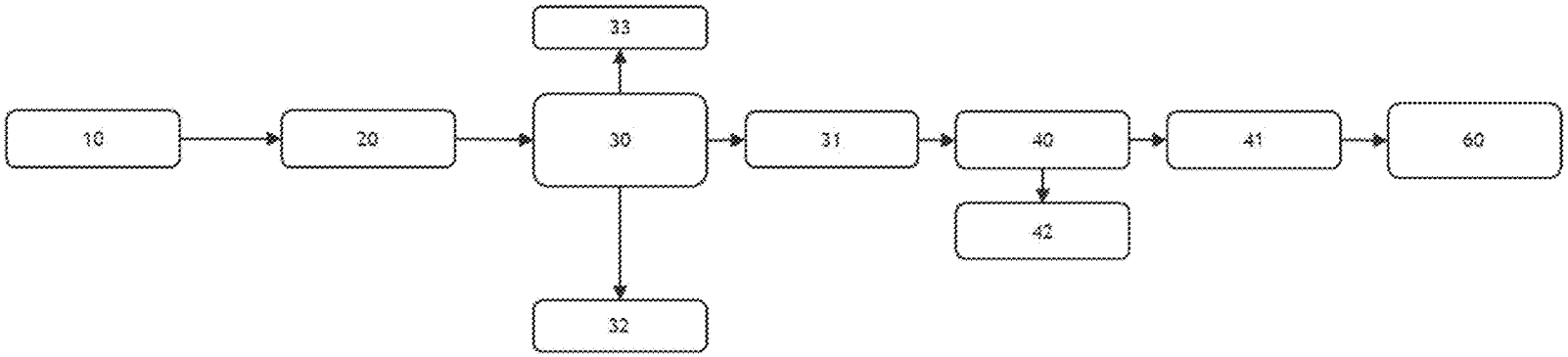
FIG. 1 illustrates a first exemplary process flow of the present method.

The present invention provides a method of purifying biomass-based lipid material to provide it better suitable for catalytic processing.

The term "biomass-based lipid material" refers to fats and/or oils of plant, microbial and/or animal origin. It also refers to any waste stream received from processing of such oils and/or fats. Generally fats are solid at room temperature and oils are liquid at room temperature. The term "biomass-based" refers to plant, microbial and/or animal origin of the material. Biomass may be in an unprocessed form (e.g. animal fat), or a processed form (used cooking oil).

Examples of biomass-based lipid material of the present invention include, but are not limited to, tall oil, the residual bottom fraction from tall oil distillation processes, animal based oils and fats, vegetable or plant based oils and fats such as sludge palm oil, used cooking oil, microbial oils, algae oils, free fatty acids, any lipids containing phosphorous and/or metals, oils originating from yeast or mold products, oils originating from biomass, rapeseed oil, canola oil, colza oil, tall oil, sunflower oil, soybean oil, hemp oil, olive oil, linseed oil, cottonseed oil, mustard oil, palm oil, *arachis* oil, castor oil, coconut oil, animal fats such as suet, tallow, blubber, recycled alimentary fats, starting materials produced by genetic engineering, and biological starting materials produced by microbes such as algae and bacteria and any mixtures of said feedstocks.

In particular, the biomass-based lipid material is animal fats and/or used cooking oil. It is to be understood that used cooking oil may comprise one or more of the above mentioned oils such as e.g. rapeseed oil, canola oil, colza oil, sunflower oil, soybean oil, hemp oil, olive oil, linseed oil, cottonseed oil, mustard oil, palm oil, *arachis* oil, castor oil, coconut oil, and animal fat.

The biomass-based lipid material to be purified by the present method typically contains impurities comprising phosphorus and/or metals in the form of phospholipids, soaps and/or salts. The impurities may for example be in the form of phosphates or sulfates, iron salts or organic salts, soaps or phospholipids. The metal impurities that may be present in the biomass-based lipid material are for example alkali metals or alkali earth metals, such as sodium or potassium salts, or magnesium or calcium salts, or any compounds of said metals.

The phosphorous compounds present in the biomass-based lipid material are typically phospholipids. The phospholipids present in the biomass-based lipid material are in particular one or more of phosphatidyl ethanolamines, phosphadityl cholines, phosphatidyl inositols, phosphatidic acids, and phosphatidyl ethanolamines.

Typically the biomass-based lipid material to be purified comprises any one or more of the following:

i) a total metal content of more than 1 ppm, especially more than 10 ppm, particularly more than 100 ppm, such as an iron content (Fe) of more than 1 ppm, especially more than 10 ppm;

ii) a sodium content (Na) of more than 1 ppm;

iii) a phosphorous content (P) of more than 20 ppm, especially more than 50 ppm, particularly more than 70 ppm;

iv) a nitrogen content (N) of more than 1 ppm, especially more than 100 ppm, particularly more than 400 ppm;

v) a free fatty acid content (FFA) more than 5 wt % of the total weight of the biomass-based lipid material, especially from 8 to 15 wt % of the total weight of the biomass-based lipid material.

In a particular example the biomass-based lipid material to be purified comprises iii) a phosphorous content (P) of more than 20 ppm, especially more than 50 ppm, particularly more than 70 ppm, and optionally any one or more of the following:

i) a total metal content of more than 1 ppm, especially more than 10 ppm, particularly more than 100 ppm, such as an iron content (Fe) of more than 1 ppm, especially more than 10 ppm;

ii) a sodium content (Na) of more than 1 ppm;

iv) a nitrogen content (N) of more than 1 ppm, especially more than 100 ppm, particularly more than 400 ppm;

v) a free fatty acid content (FFA) more than 5 wt % of the total weight of the biomass-based lipid material, especially from 8 to 15 wt % of the total weight of the biomass-based lipid material.

In a further particular example the biomass-based lipid material to be purified comprises i) a total metal content of more than 300 ppm;

ii) a sodium content (Na) of more than 80 ppm iii) a phosphorous content (P) of more than 80 ppm;

iv) a nitrogen content (N) of more than 500 ppm;

v) a free fatty acid content (FFA) especially from 8 to 15 wt % of the total weight of the biomass-based lipid material.

Accordingly provided herein is a method of purifying biomass-based lipid material, comprising the steps of (a) providing a feed of biomass-based lipid material;

(c) optionally drying the feed of biomass-based lipid material;

(d) removing oxygen from the feed of biomass-based lipid material under reduced pressure;

(e) heat treating the feed of biomass-based lipid material at 180 to 300° C. under reduced pressure to solidify at least part of phosphorous and/or metal containing impurities comprised in the biomass-based lipid material, simultaneously distilling off at least part of free fatty acids and low molecular weight nitrogen compounds comprised in the biomass-based lipid material, to obtain at least a fraction comprising free fatty acids and low molecular weight nitrogen compounds, and heat treated biomass-based lipid material comprising degraded phosphorous and/or metal containing impurities in solid form; and (f) removing the solid degraded phosphorous and/or metal containing impurities from the second fraction;

to obtain purified biomass-based lipid material.

In step (e) the biomass-based lipid material is heated to cause thermal reactions that disrupt phosphorus and metal containing impurities comprised in the biomass-based lipid material creating a solid material that can be subsequently removed from the heat treated biomass-based lipid material e.g. by filtration. Also FFAs present in the biomass-based lipid material may esterify with the glycerol of mono- or diglycerides, in particular when the water content of the biomass-based lipid material is low. This leads to less FFAs distilled as the separate fraction. Under some circumstances FFAs may also be converted to oligomers, however this is not desirable. Performing the heat treatment in distillation equipment where the feed is simultaneously allowed to distil leads to simultaneous removal of lower boiling FFAs and low molecular weight nitrogen compounds from the biomass-based lipid material as the lower boiling FFAs and the low molecular weight nitrogen compounds comprised in the biomass-based lipid material are distilled off from the biomass-based lipid material.

The heat treatment of step (e) takes place at any temperature from 180 to 300° C. For achieving optimal results, step (e) is performed at 240 to 280° C. The time during which the biomass-based lipid material is heated and held at the desired temperature, i.e. residence time, is typically from 1 to 300 min, preferably from 5 to 240 min, more preferably from 30 to 90 min in step (e).

The reduced pressure in step (e) is such that distillation fractionating a first comprising free fatty acids and low molecular weight nitrogen compounds and bottom comprising heat treated biomass-based lipid material comprising degraded phosphorous and/or metal containing impurities in solid form is achieved. Typically the pressure in step (e) is from 0.01 to 50 kPa, preferably from 0.1 to 4 kPa.

Prior to step (e) the feed of biomass-based lipid material is subjected to removing oxygen under reduced pressure. Removal of oxygen from the feed of biomass-based lipid material prior to heat treatment/distillation of step (e) reduces the amount of oligomers that may be formed from the FFAs during the step (e). This is desirable as oligomers may cause catalyst deactivation in catalytic processing of the purified biomass-based lipid material.

Typically removing oxygen in step (d) is accomplished by heating at any temperature from 80 to 120° C. under reduced pressure. The time during which the biomass-based lipid material is heated and held at the desired temperature, i.e. residence time, is typically from 1 to 60 min, preferably from 1 to 30 min, more preferably from 1 to 10 min in step (d).

The reduced pressure in step (d) is such that removal of oxygen is achieved. Typically the pressure in step (d) is from 0.2 to 1.5 kPa, preferably from 0.2 to 0.5 kPa.

The water content of the biomass-based lipid material to be treated in step (e) in accordance with the present method is typically lower or equal to 10000 ppm, such as e.g. lower than 5000 ppm, such as e.g. lower than 2000 ppm, such as e.g. lower than 1500 ppm, such as e.g. lower than 1000 ppm, such as e.g. lower than 500 ppm, such as e.g. lower than 250 ppm, such as e.g. lower than 100 ppm, such as e.g. lower than 50 ppm, such as e.g. lower than 25 ppm, such as e.g. lower than 10 ppm, such as e.g. lower than 5 ppm, such as e.g. lower than 1 ppm or such that the biomass-based lipid material is substantially water free. Preferably the water content of the biomass-based lipid material to be purified is lower than 5 ppm.

If desired the biomass-based lipid material to be treated in step (e) may be subjected to drying prior to step (e) to sufficiently lower the water content of the biomass-based lipid material. Low water content of the biomass-based lipid material decreases hydrolysis of triglycerides present in the biomass-based lipid material to FFAs during the process and renders the process more controllable. Furthermore, presence of water in the fraction comprising free fatty acids and low molecular weight nitrogen compounds is not desired.

Accordingly step (e) is performed in dry conditions. Steam may be added, e.g. injected, to step (e) for heating purposes, but due to the process conditions of step (e), in particular the reduced pressure, water is instantly removed.

Accordingly in first example the present method comprises the steps of (a) providing a feed of biomass-based lipid material;

(c) drying the feed of biomass-based lipid material;

(d) removing oxygen from the feed of biomass-based lipid material under reduced pressure;

(e) heat treating and distilling the feed of biomass-based lipid material as discussed herein to obtain at least a fraction comprising free fatty acids and low molecular weight nitrogen compounds, and heat treated biomass-based lipid material comprising degraded phosphorous and/or metal containing impurities in solid form; and f) removing the solid degraded phosphorous and/or metal containing impurities from the second fraction;

to obtain purified biomass-based lipid material.

Steps (c) and (d) may be accomplished for example by (c) first drying the feed of biomass-based lipid material in a heated vessel under small vacuum. This is typically accomplished at any temperature from 80 to 120° C. under reduced pressure of typically from 5 to 10 kPa. Then the dried feed of biomass-based lipid material may be introduced into the distillation equipment, e.g. deodorizer, wherein (d) oxygen is first removed, typically at any temperature from 80 to 120° C., under reduced pressure, typically from 0.2 to 1.5 kPa, preferably from 0.2 to 0.5 kPa.

The deoxygenated and dried feed of biomass-based lipid material is then subjected to the heat treatment/distillation of step (e) as discussed herein, preferably in the same distillation equipment as in step (d).

Prior to the heat treatment/distillation of step (e) the feed of biomass-based lipid material may also be subjected to one or more pretreatment step(s). Suitable pretreatment steps include, but are not limited to, water degumming, acid degumming, filtration and bleaching, in any combinations thereof and in any order. These pretreatments lead to reduction of the amount of phosphorus and metals in the feed of biomass-based lipid material.

Accordingly in second example the present method comprises the steps of (a) providing a feed of biomass-based lipid material;

(b) pretreating the feed of biomass-based lipid material;

(c) optionally drying the feed of biomass-based lipid material;

(d) removing oxygen from the feed of biomass-based lipid material under reduced pressure;

(e) heat treating and distilling the feed of biomass-based lipid material as discussed herein to obtain at least a fraction comprising free fatty acids and low molecular weight nitrogen compounds, and heat treated biomass-based lipid material comprising degraded phosphorous and/or metal containing impurities in solid form; and (f) removing the solid degraded phosphorous and/or metal containing impurities from the second fraction;

to obtain purified biomass-based lipid material.

After the heat treatment/distillation of step (e) the solid material created due to the heat treatment is removed. Accordingly in step (f) degraded phosphorous and/or metal containing impurities in solid form are removed from second fraction comprising heat treated biomass-based lipid material comprising degraded phosphorous and/or metal containing impurities in solid form.

Removal of the solid material may be achieved for example by any separation method found suitable by a skilled person for separation of the solid material from the heat treated biomass-based lipid material. Suitable examples include, but are not limited to, filtration, centrifugation, and phase separation. It is also to be understood that several separation methods, e.g. filtration and centrifugation, may be combined.

FIG. 1 illustrates a first exemplary process flow of the present method.

Referring to FIG. 1, a feed of biomass-based lipid material 10 is subjected to a step of removing oxygen 20 from the feed of biomass-based lipid material under reduced pressure. The treated feed of biomass-based lipid material is then heat treated and distilled 30 as discussed herein for step (e) and a bottom containing heat treated biomass-based lipid material comprising degraded phosphorous and/or metal containing impurities in solid form 31, a fraction comprising free fatty acids and low molecular weight nitrogen compound 32 and off-gas 33 is obtained. The heat treated biomass-based lipid material comprising degraded phosphorous and/or metal containing impurities in solid form 31 is the subjected to removal of the solid impurities, e.g. by filtration, to obtain to obtain purified biomass-based lipid material 41 and solid impurities 42. The purified biomass-based lipid material 41 may then be subjected to catalytic upgrading 60.

In accordance with the present method, the heat treated biomass-based lipid material may be subjected to further post-treatment steps before or after the removal step (f). The removal step (f) may also be combined with other post treatment steps such as bleaching, i.e. clay adsorption step, to improve the removal of impurities. With the present method a higher yield of triglycerides can be achieved after bleaching than when the heat treatment/distillation of step (e) is omitted.

Further suitable post treatment steps that may be employed in accordance with the present invention include, but are not limited to, acid or water degumming and bleaching. Preferably the heat treated biomass-based lipid material is subjected to bleaching.

Accordingly in fourth example the present method comprises the steps of (a) providing a feed of biomass-based lipid material;

(b) optionally pretreating the feed of biomass-based lipid material (c) optionally drying the feed of biomass-based lipid material;

(d) removing oxygen from the feed of biomass-based lipid material under reduced pressure;

(e) heat treating and distilling the feed of biomass-based lipid material as discussed herein to obtain at least a fraction comprising free fatty acids and low molecular weight nitrogen compounds, and heat treated biomass-based lipid material comprising degraded phosphorous and/or metal containing impurities in solid form; and f) removing the solid degraded phosphorous and/or metal containing impurities from the second fraction;

to obtain purified biomass-based lipid material; and (g) post treating the purified biomass-based lipid material.

Figure 2:
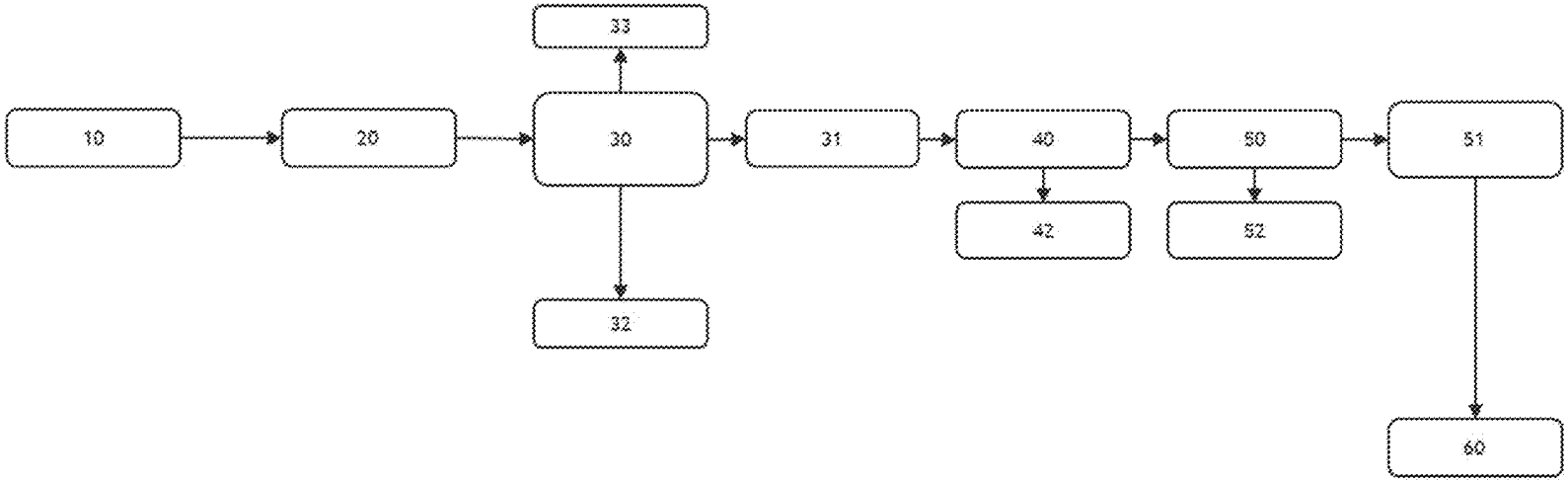
FIG. 2 illustrates a second exemplary process flow of the present method.

FIG. 2 illustrates a second exemplary process flow of the present method.

Referring to FIG. 2, a feed of biomass-based lipid material 10 is subjected to a step of removing oxygen 20 from the feed of biomass-based lipid material under reduced pressure. The treated feed of biomass-based lipid material is then heat treated and distilled 30 as discussed herein for step (e) and a bottom containing heat treated biomass-based lipid material comprising degraded phosphorous and/or metal containing impurities in solid form 31, a fraction comprising free fatty acids and low molecular weight nitrogen compound 32 and off-gas 33 is obtained. The heat treated biomass-based lipid material comprising degraded phosphorous and/or metal containing impurities in solid form 31 is the subjected to removal of the solid impurities, e.g. by filtration, to obtain to obtain purified biomass-based lipid material (41, not shown) and solid impurities 42. The purified biomass-based lipid material is then subjected to bleaching 50 to obtain purified, bleached biomass-based lipid material 51 and spent bleaching earth 52. The purified and bleached biomass-based lipid material 51 may then be subjected to catalytic upgrading 60.

The biomass-based lipid material purified in accordance with the present method typically comprises significantly lower content of FFAs and nitrogen as compared to the biomass-based lipid material prior to purification.

Preferably the purified biomass-based lipid material comprises less than 5 wt %, in particular less than 1 wt %, more particularly less than 0.1 wt % FFAs, of the total weight of the purified biomass-based lipid material.

Preferably the purified biomass-based lipid material comprises less than 70%, more preferably less than 60%, even more preferably less than 40% of the nitrogen (N) originally present in the unpurified biomass-based lipid material of the nitrogen (N) present in the unpurified biomass-based lipid material, when comparing the amount of nitrogen as wt % of the total weight of the biomass-based lipid material.

After the biomass-based lipid material has been purified in accordance with the present method, it may be subjected to further processing e.g. catalytic upgrading. Such catalytic upgrading processes include, but are not limited to, catalytic cracking, thermo-catalytic cracking, catalytic hydrotreatment, fluid catalytic cracking, catalytic ketonization, catalytic esterification, or catalytic dehydration. Such processes require the biomass-based lipid material to be sufficiently pure and free from impurities that may otherwise hamper the catalytic process or poison the catalyst(s) present in the process.

It is possible to combine the purified biomass-based lipid material with the first fraction comprising free fatty acids and low molecular weight nitrogen compounds prior to a catalytic upgrading. This improves the yield of the final product. The first fraction comprising free fatty acids and low molecular weight nitrogen compounds may also be used for other purposes such as combustion to energy or re-esterification with glycerol.

Figure 3:
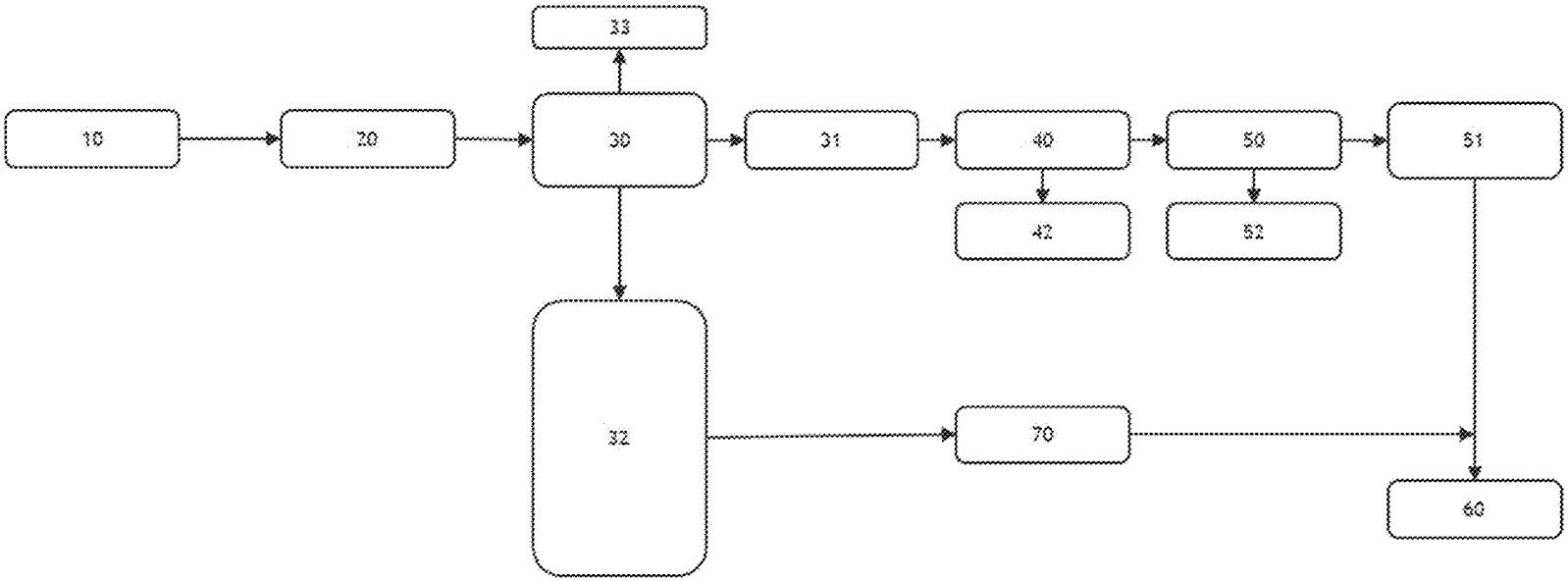
FIG. 3 illustrates a third exemplary process flow of the present method.

FIG. 3 illustrates a third exemplary process flow of the present method.

Referring to FIG. 3, a feed of biomass-based lipid material 10 is subjected to a step of removing oxygen 20 from the feed of biomass-based lipid material under reduced pressure. The treated feed of biomass-based lipid material is then heat treated and distilled 30 as discussed herein for step (e) and a bottom containing heat treated biomass-based lipid material comprising degraded phosphorous and/or metal containing impurities in solid form 31, a fraction comprising free fatty acids and low molecular weight nitrogen compound 32 and off-gas 33 is obtained. The heat treated biomass-based lipid material comprising degraded phosphorous and/or metal containing impurities in solid form 31 is the subjected to removal of the solid impurities, e.g. by filtration, to obtain to obtain purified biomass-based lipid material (41, not shown) and solid impurities 42. The purified biomass-based lipid material is then subjected to bleaching 50 to obtain purified, bleached biomass-based lipid material 51, and spent bleaching earth 52. The purified and bleached biomass-based lipid material 51 is the combined with the fraction comprising free fatty acids and low molecular weight nitrogen compounds 31 after it has been subjected to pretreatment 70 e.g. nitrogen removal. The combined mixture may then be subjected to catalytic upgrading 60.

EXAMPLES

Reference Example

Example 1

Heat Treatment Under Vacuum

Animal fat was heat treated under vacuum in a distillation flask. The drying and oxygen removal were performed in the same distillation flask during the beginning of the distillation using low pressure and elevated temperature around 100° C. After the drying and deoxygenation was performed, the heating of the animal fat was continued. The residence time of the animal fat at a temperature between 200 and 295° C. was 180 minutes. The pressure of the system was 4 to 5 mbar. After this the oil was cooled to room temperature under reduced pressure.

The heat treatment under vacuum yielded three fractions: cold trap (1.1% of the feed), distillate, i.e., the FFA fraction (11.0%) and the bottom fraction, i.e., the heat treated product (87.7%). The total yield was 99.8%.

The analyses of the original animal fat, the heat treated product and the separated FFA fraction are presented in Table 1.

TABLE 1

Original animal fat (AF), heat treated product, and the separated FFA fraction (distillate)

| | | | Original AF | Heat treated product | Distillate |
|---|---|---|---|---|---|
| ASTMD6304-C | WATER-CULOM | mg/kg | | 63 | 673 |
| ASTMD6304-C | WATER-CULOM | wt-% | 0.13 | | |
| ASTMD4629 | NITROGEN | mg/kg | 910 | 450 | 3000 |
| | MONOGLY | area-% | <0.1 | <0.1 | <0.1 |
| | DIGLY | area-% | 14.4 | 11.5 | 1.1 |
| | TRIGLY. | area-% | 68.9 | 83.7 | 2.5 |
| | OLIGOMERS | area-% | 0.4 | 2.1 | <0.1 |
| | FATTY-ACIDS | area-% | 16.4 | 2.7 | 96.4 |
| ASTMD5185 | IRON-ICP | mg/kg | 1.3 | 0.52 | 1.4 |
| ASTMD5185 | SODIUM-ICP | mg/kg | 27 | 11 | 1.8 |
| ASTMD5185 | CALCIUM-ICP | mg/kg | 40 | 7.3 | 0 |
| ASTMD5185 | MAGNESIUM-ICP | mg/kg | 1.6 | 0.34 | 1.9 |

TABLE 1-continued

| Original animal fat (AF), heat treated product, and the separated FFA fraction (distillate) | | | | | |
|---|---|---|---|---|---|
| | | | Original AF | Heat treated product | Distillate |
| ASTMD5185 | PHOSPHORUS-ICP | mg/kg | 45 | 9.8 | 3.1 |
| | XRF-S | mg/kg | 89 | 97 | 63 |
| | XRF-CL | mg/kg | <2.0 | 4 | 14 |

Sulphur and chloride were analysed using X-ray fluorescence (XRF) analysis. The glyceride profile of the samples was analysed using gel permeation chromatography (GPC)

Processing of the Fractions from Heat Treatment

The heat treated product containing the solid material created during the heat treatment was bleached by first adding 1000 ppm citric acid and 0.2 wt % water to the heat treated product (85° C., residence time 7 minutes under efficient mixing). After this 1 wt % of acidic bleaching clay (Tonsil 9192FF) was added. This mixture was kept under mixing in 85° C. for 20 minutes under pressure of 800 mbar. After this stage the temperature was raised to 105° C. for 25 minutes under pressure of 80 mbar. After this the mixture was filtered through a pre-cake produced from the same bleaching clay. The temperature during the filtration was 105° C.

The same processing was also done for the original animal fat and the combined heat treated product and the FFA fraction. The results are presented in Table 2.

TABLE 2

| Original animal fat, heat treated product, distillate and a mixture of the heat treated product and distillate ((11 wt-%) and heat treated product (89 wt-%)) after bleaching | | | | | | |
|---|---|---|---|---|---|---|
| | | | Original animal fat after bleaching | Heat treated product after bleaching | Distillate after bleaching | A mixture of the distillate after bleaching |
| | FILTRATION | Pas/kg$^2$ | 520 | 470 | 150 | 380 |
| ASTMD5762 | NITROGEN | mg/kg | 705 | 309 | 1421 | 545 |
| | MONOGLY | area-% | | <0.1 | | <0.1 |
| | DIGLY | area-% | | 11.7 | | 11 |
| | TRIGLY. | area-% | | 83.6 | | 75.5 |
| | OLIGOMERS | area-% | | 2.2 | | 2 |
| | FATTY-ACIDS | area-% | | 2.5 | | 11.5 |
| ASTMD5185 | IRON-ICP | mg/kg | <0.2 | <0.2 | 1.5 | <0.2 |
| ASTMD5185 | SODIUM-ICP | mg/kg | 1.7 | <0.8 | 6.2 | <0.8 |
| ASTMD5185 | CALCIUM-ICP | mg/kg | <0.4 | <0.4 | 7.6 | <0.4 |
| ASTMD5185 | MAGNESIUM-ICP | mg/kg | <0.3 | <0.3 | 7.8 | <0.3 |
| ASTMD5185 | PHOSPHORUS-ICP | mg/kg | 2.8 | 0.83 | 3 | <0.6 |

Filtration resistance is a calculated from the filtration flux and low resistance means high flux.

It will be obvious to a person skilled in the art that, as the technology advances, the inventive concept can be implemented in various ways. The invention and its embodiments are not limited to the examples described above but may vary within the scope of the claims.

The invention claimed is:

1. A method of purifying biomass-based lipid material, comprising:

providing a feed of biomass-based lipid material; drying the feed of biomass-based lipid material;

removing oxygen from the feed of biomass-based lipid material under reduced pressure;

heat treating the feed of biomass-based lipid material at 180 to 300° C. under reduced pressure to solidify at least part of phosphorous or metal or containing impurities within the biomass-based lipid material, simultaneously distilling off at least part of free fatty acids and low molecular weight nitrogen compounds in the biomass-based lipid material, to obtain at least a fraction containing free fatty acids and low molecular weight nitrogen compounds, and heat treated biomass-based lipid material containing at least one of degraded phosphorous or metal containing impurities in solid form; and removing the solid degraded phosphorous or metal containing impurities from the second fraction to obtain purified biomass-based lipid material.

2. A method as claimed in claim 1, comprising:

pretreating the feed of biomass-based lipid material before the drying.

3. A method as claimed in claim 1, comprising:

optionally pretreating the feed of biomass-based lipid material before the drying; and (g) post treating the purified biomass-based lipid material.

4. A method as claimed in claim 1, wherein the heat treating is performed at 240 to 280° C.

5. A method as claimed in claim 1, wherein the pressure in the heat treating is from at least one of 0.01 to 50 kPa, or from 0.1 to 4 kPa.

6. A method as claimed in claim 1, wherein water content of the biomass-based lipid material to be heat treated is lower than 5 ppm.

7. A method as claimed in claim 1, wherein the drying is accomplished at any temperature from 80 to 120° C. under reduced pressure of from 5 to 10 kPa.

8. A method as claimed in claim 1, wherein the removing oxygen is accomplished by heating at any temperature from 80 to 120° C. under reduced pressure from at least one of 0.2 to 1.5 kPa, or from 0.2 to 0.5 kPa.

9. A method as claimed in claim 1, wherein the biomass-based lipid material to be purified comprises:

a phosphorous content (P) of at least one of more than 20 ppm, more than 50 ppm, or more than 70 ppm.

10. A method as claimed in claim 1, comprising:

subjecting the heat treated biomass-based lipid material to bleaching.

11. A method as claimed in claim 1, comprising:

combining the purified biomass-based lipid material with the first fraction containing free fatty acids and low molecular weight nitrogen compounds prior to a catalytic upgrading.

12. A method as claimed in claim 2, wherein the heat treating is performed at 240 to 280° C.

13. A method as claimed in claim 12, wherein the pressure in the heat treating is from at least one of 0.01 to 50 kPa, or from 0.1 to 4 kPa.

14. A method as claimed in claim 13, wherein water content of the biomass-based lipid material to be heat treated is lower than 5 ppm.

15. A method as claimed in claim 14, wherein the drying is accomplished at any temperature from 80 to 120° C. under reduced pressure of from 5 to 10 kPa.

16. A method as claimed in claim 15, wherein the removing oxygen is accomplished by heating at any temperature from 80 to 120° C. under reduced pressure from at least one of 0.2 to 1.5 kPa, or from 0.2 to 0.5 kPa.

17. A method as claimed in claim 16, wherein the biomass-based lipid material to be purified comprises:

a phosphorous content (P) of at least one of more than 20 ppm, more than 50 ppm, or more than 70 ppm.

18. A method as claimed in claim 17, comprising:

subjecting the heat treated biomass-based lipid material to bleaching.

19. A method as claimed in claim 18, comprising:

combining the purified biomass-based lipid material with the first fraction containing free fatty acids and low molecular weight nitrogen compounds prior to a catalytic upgrading.

* * * * *